US006312142B1

(12) United States Patent
Dorsa

(10) Patent No.: US 6,312,142 B1
(45) Date of Patent: Nov. 6, 2001

(54) LAMP ASSEMBLY WITH DIFFRACTION GRATING REFLECTOR

(76) Inventor: Albert N. Dorsa, Box 3761, Christiansted, St. Croix 00822 (VI)

( * ) Notice: Subject to any disclaimer, the term of this patent is extended or adjusted under 35 U.S.C. 154(b) by 0 days.

(21) Appl. No.: 09/482,051

(22) Filed: Jan. 13, 2000

(51) Int. Cl.[7] ..... F21S 14/00

(52) U.S. Cl. ..... 362/257; 362/304; 362/293; 362/343; 362/811

(58) Field of Search ..... 362/257, 293, 362/304, 343, 811; 359/558, 572, 838, 567

(56) References Cited

U.S. PATENT DOCUMENTS 3,515,459 * 6/1970 Wood ..... 359/567
3,700,879 * 10/1972 Franc ..... 362/189
4,725,934 * 2/1988 Gordin ..... 362/298

* cited by examiner

*Primary Examiner*—Sandra O'Shea
*Assistant Examiner*—David V. Hobden
(74) *Attorney, Agent, or Firm*—Donald A. Kettlestrings

(57) ABSTRACT

A lamp assembly includes a diffraction grating, such as a CD, CD-ROM, DVD, laserdisc, mini disc or the like, positioned with respect to the light bulb for reflecting light from the bulb to produce a pleasing spectral visual effect.

16 Claims, 6 Drawing Sheets

LAMP ASSEMBLY WITH DIFFRACTION GRATING REFLECTOR

BACKGROUND OF THE INVENTION

This invention relates to a lamp assembly and more particularly to a lamp assembly which uses a diffraction grating as a reflector for producing a pleasing spectral visual effect.

The reflective and diffractive properties of compact discs, CD-ROM, DVD, laserdiscs, mini discs and the like are well known. While primarily valued for their data storage capacity, CDs and the like have also found uses in merchandise strictly for their cosmetic properties. One example of such use is as a clock face. CDs, and the like, have two distinctive visual properties. A CD is mirror-like and reflective, and it is embossed with fine concentric lines producing a diffraction grating. When a light bulb is mounted in close proximity to the disc and viewed from a forwardly biased position, the disc both reflects some of the light rays and diffracts the light rays into the colors of the spectrum. The intensity of this visual effect is related to the quality of light (brightness, color temperature, etc.) and the viewing angle.

It is, therefore, an object of the present invention to provide a lamp assembly which uses a diffraction grating, such as a CD, as a reflector to produce a pleasing spectral visual effect.

Another object is to provide such a lamp assembly which uses a CD, CD-ROM, DVD, laserdisc, mini disc, or the like as a reflector to produce a pleasing spectral visual effect.

A further object is to provide such a lamp assembly which includes printed matter on the diffractive surface of the diffraction grating for creating a design, designs and/or information.

Still another object is to provide such a lamp assembly which uses a mask element removably connected to or positioned on the diffraction grating for covering and exposing portions of the diffractive surface to create a design, designs and/or information.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides a lamp assembly, comprising: a support; a light bulb socket connected to the support for removably receiving a light bulb within the socket; an electrical conductor connected in electrical circuit relationship with the socket for conducting electricity to a light bulb within the socket from a conventional source of electrical power; and a diffraction grating connected in operative relationship with the socket and with respect to a light bulb within the socket for reflecting light from the light bulb to produce a pleasing spectral visual effect.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate preferred embodiments of the invention and, together with the description, serve to explain the principles of the invention.

DESCRIPTION OF THE PREFERRED EMBODIMENTS

Figure 1:
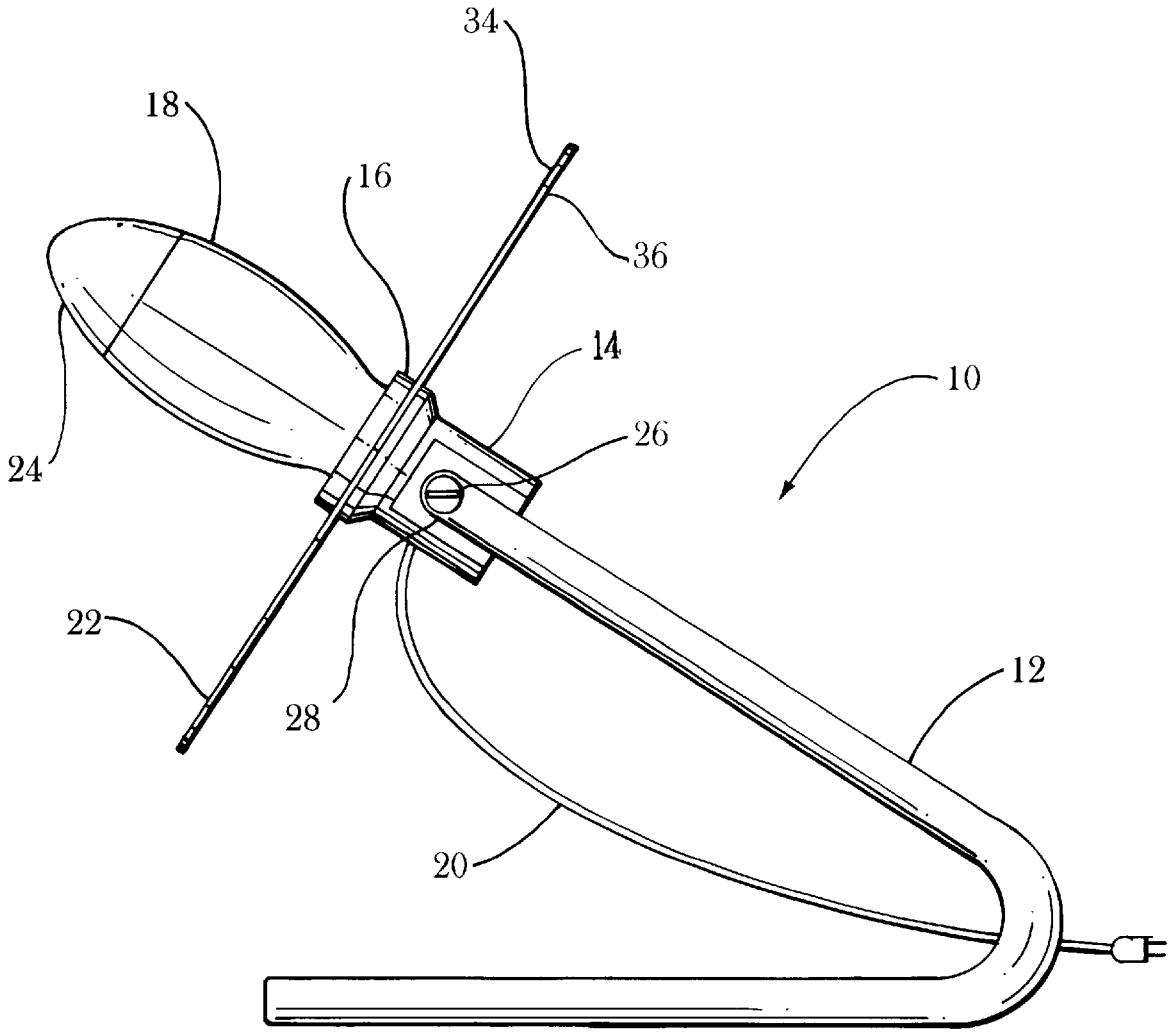
FIG. 1 is a side elevation view of a preferred embodiment of the lamp assembly.
Figure 2:
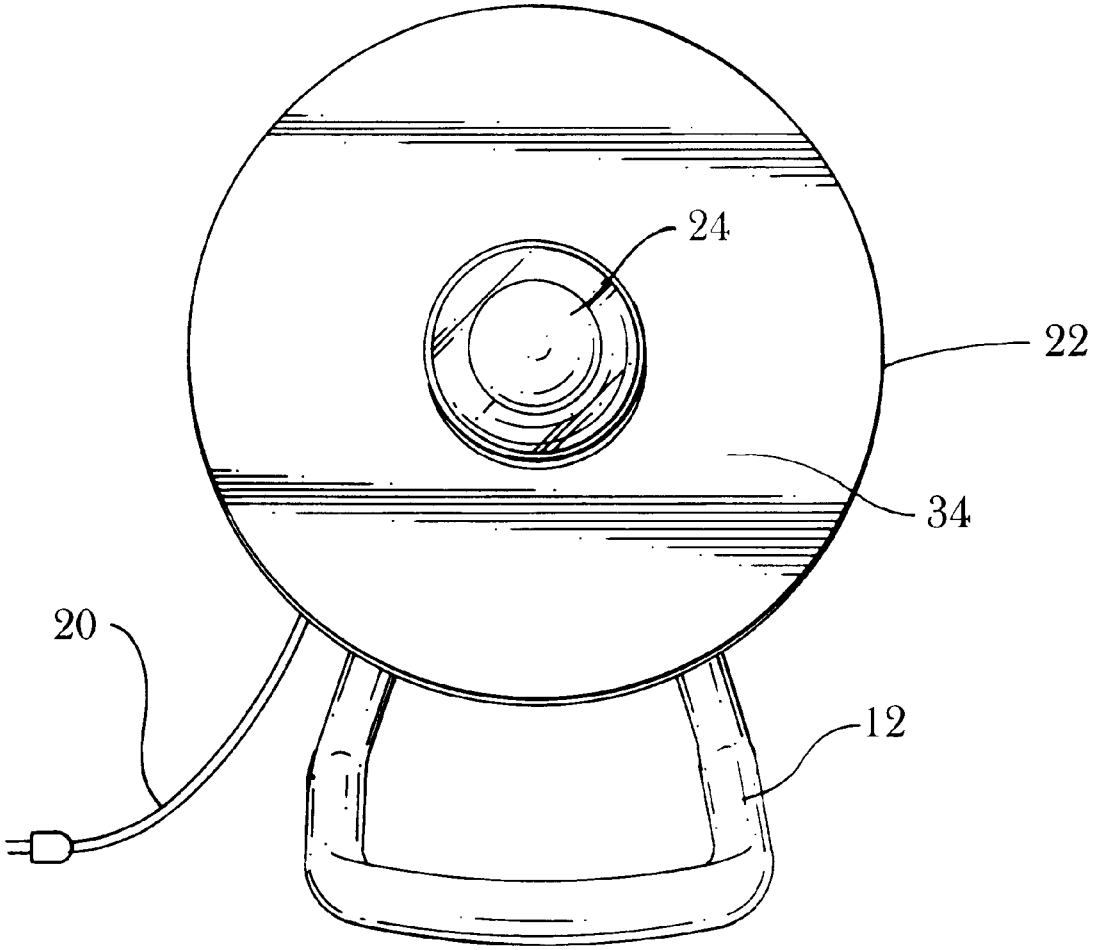
FIG. 2 is a front elevation view of the lamp assembly shown in FIG. 1.
Figure 3:
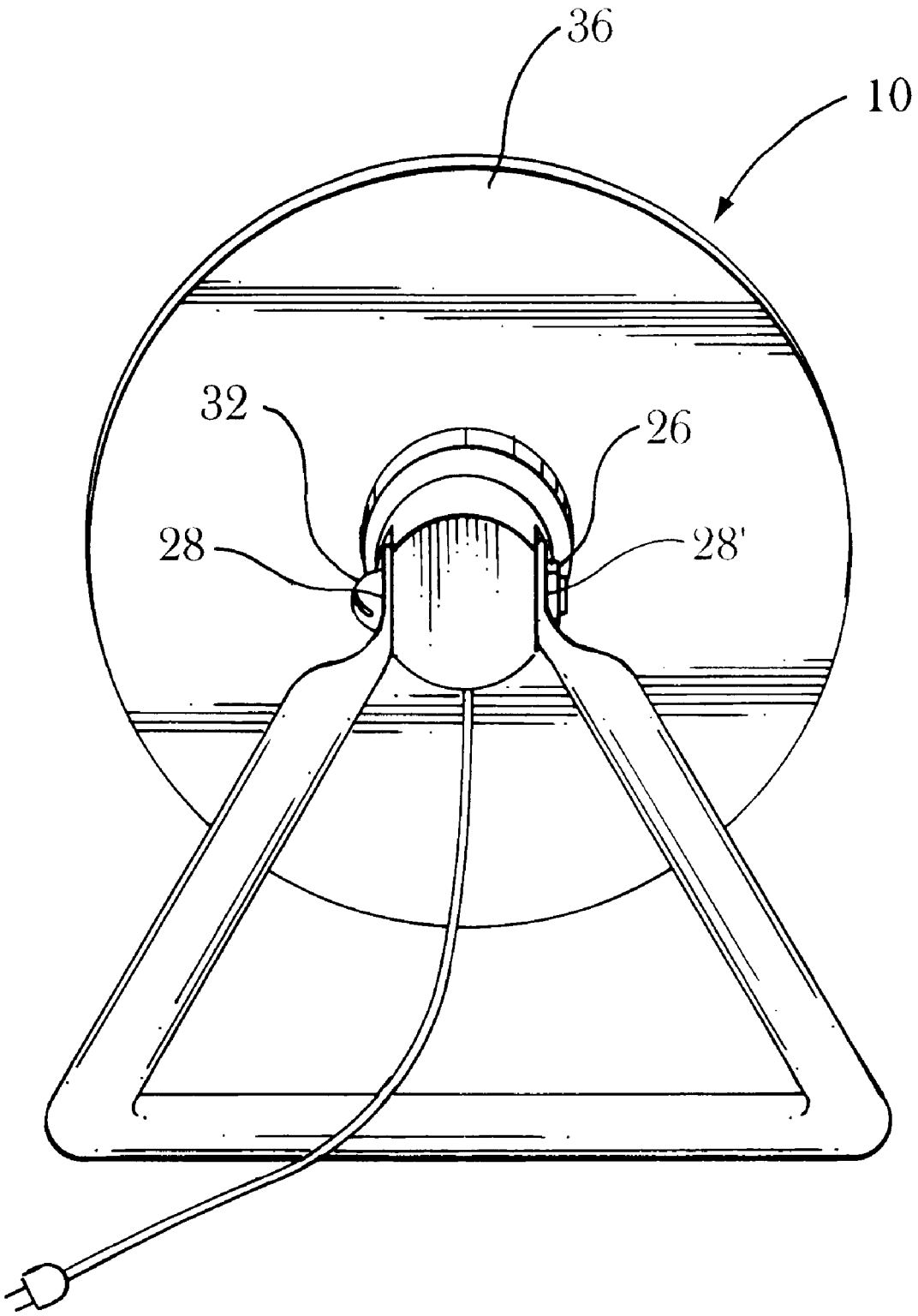
FIG. 3 is a rear elevation view of the lamp assembly shown in FIGS. 1 and 2.
Figure 4:
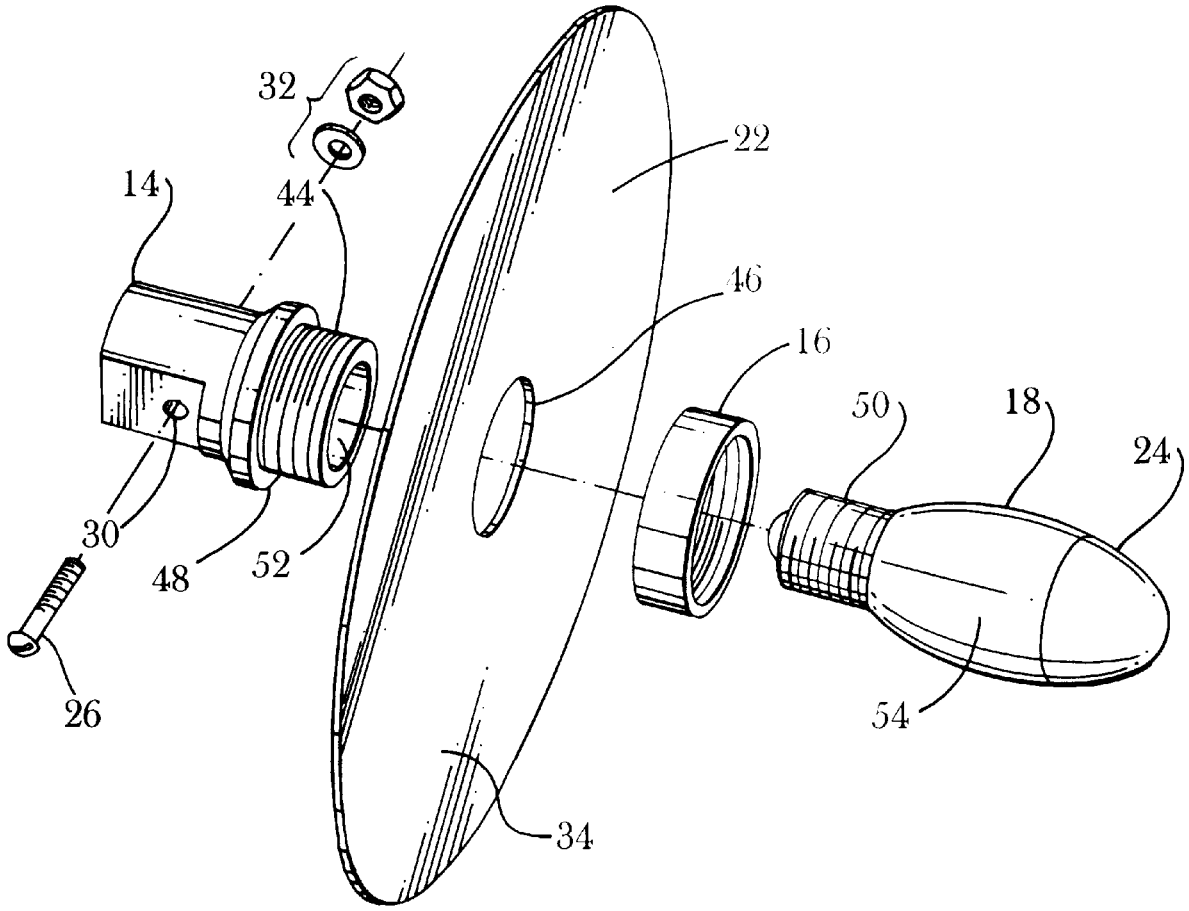
FIG. 4 is an exploded perspective view showing some elements of the lamp assembly.

With reference now to the drawings, wherein like reference characters designate like or corresponding parts throughout the several views, there is shown a lamp assembly 10 which includes a support 12. A conventional light bulb socket 14 is connected to support 12 by bolt 26 in cooperation with nut and washer combination 32. Socket 14 conventionally removably receives a light bulb 18 within socket 14, and an electrical conductor 20 is connected in electrical circuit relationship with socket 14 for conducting electricity to bulb 18 within socket 14 from a source of electrical power (not shown).

A diffraction grating 22 is connected to socket 14 by retaining ring 16, and diffraction grating 22 is positioned with respect to light bulb 18, located within socket 14, for reflecting light from bulb 18 to produce a pleasing spectral visual effect.

Light bulb 18 preferably includes a reflective surface 24 at the distal end of bulb 18 for reflecting and directing light from bulb 18 back toward diffraction grating 22 when bulb 18 is positioned within socket 14. Reflective surface 24 also prevents light from bulb 18 from shining directly into a viewer's eyes.

Light bulb 18, socket 14 and diffraction grating 22 are preferably positioned in coaxial relationship with each other, as illustrated. Socket 14 is preferably adjustably connected to support 12 by means of bolt 26 which removably passes through openings 28, 28' in support 12 and which passes through opening 30 in socket 14. A conventional nut and washer combination 32 tightens bolt 26 in position. By suitably tightening nut and washer combination 32, socket 14 and diffraction grating 22 will be firmly held in position while permitting adjustment of their positions by rotating socket 14 about bolt 26. In this manner, a desirable position of socket 14, bulb 18 and diffraction grating 22 can be achieved and maintained.

Diffraction grating 22 is preferably in the form of a flat disc, and diffraction grating 22 can be a CD, CD-ROM, DVD, laserdisc, mini disc or the like.

Diffraction grating 22 includes a first diffractive surface 34 and a second opposed surface 36. Diffractive surface 34 is positioned with respect to light bulb 18, as illustrated, for reflecting light from bulb 18 to produce an aesthetically pleasing spectral visual effect.

Figure 5:
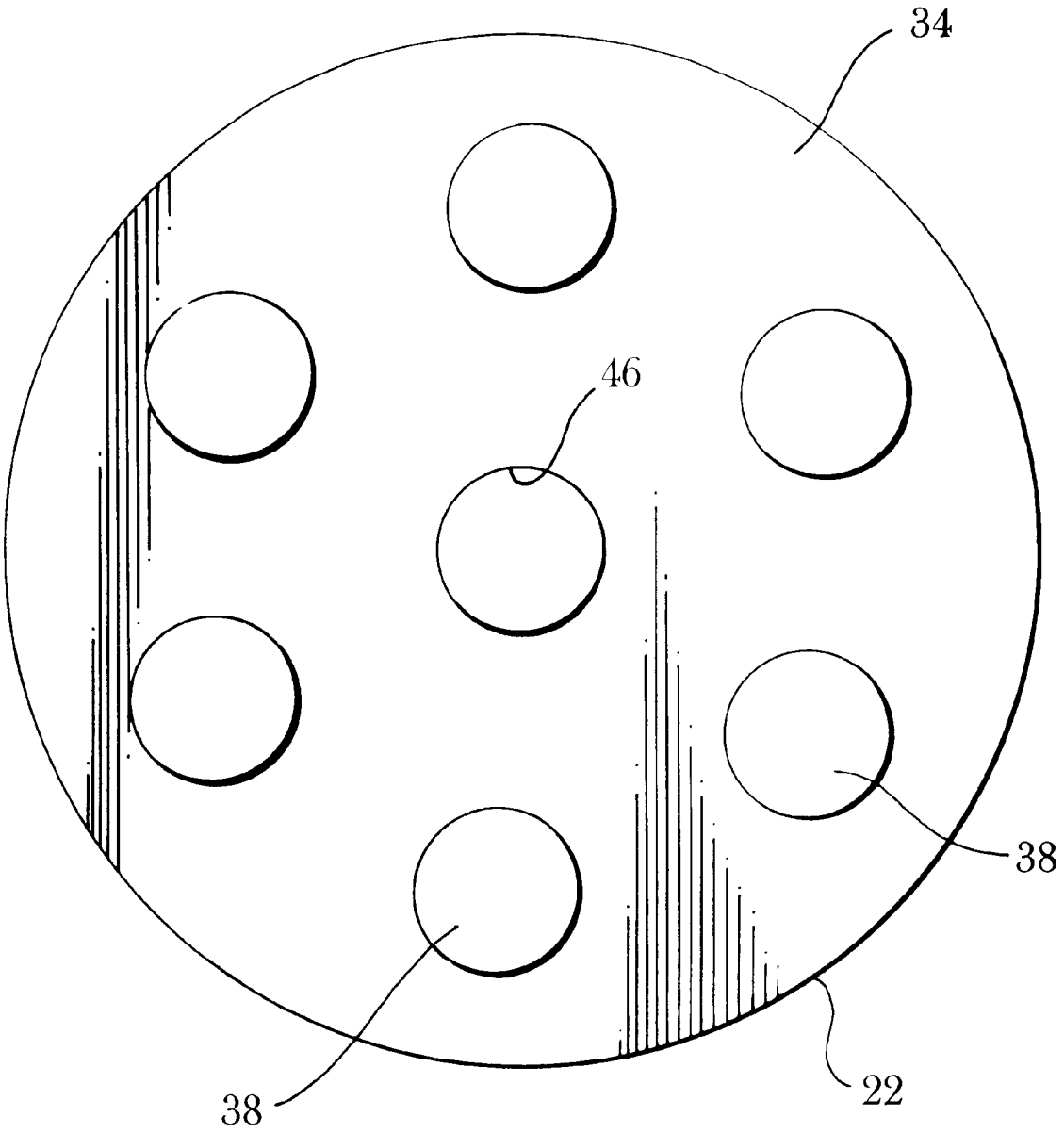
FIG. 5 is a front elevation view showing a diffraction grating disc having printed matter on the disc.

In accordance with the invention, printed matter 38 may be conventionally positioned onto diffractive surface 34 for creating a predetermined design, designs and/or information. This embodiment is illustrated in FIG. 5.

Figure 6:
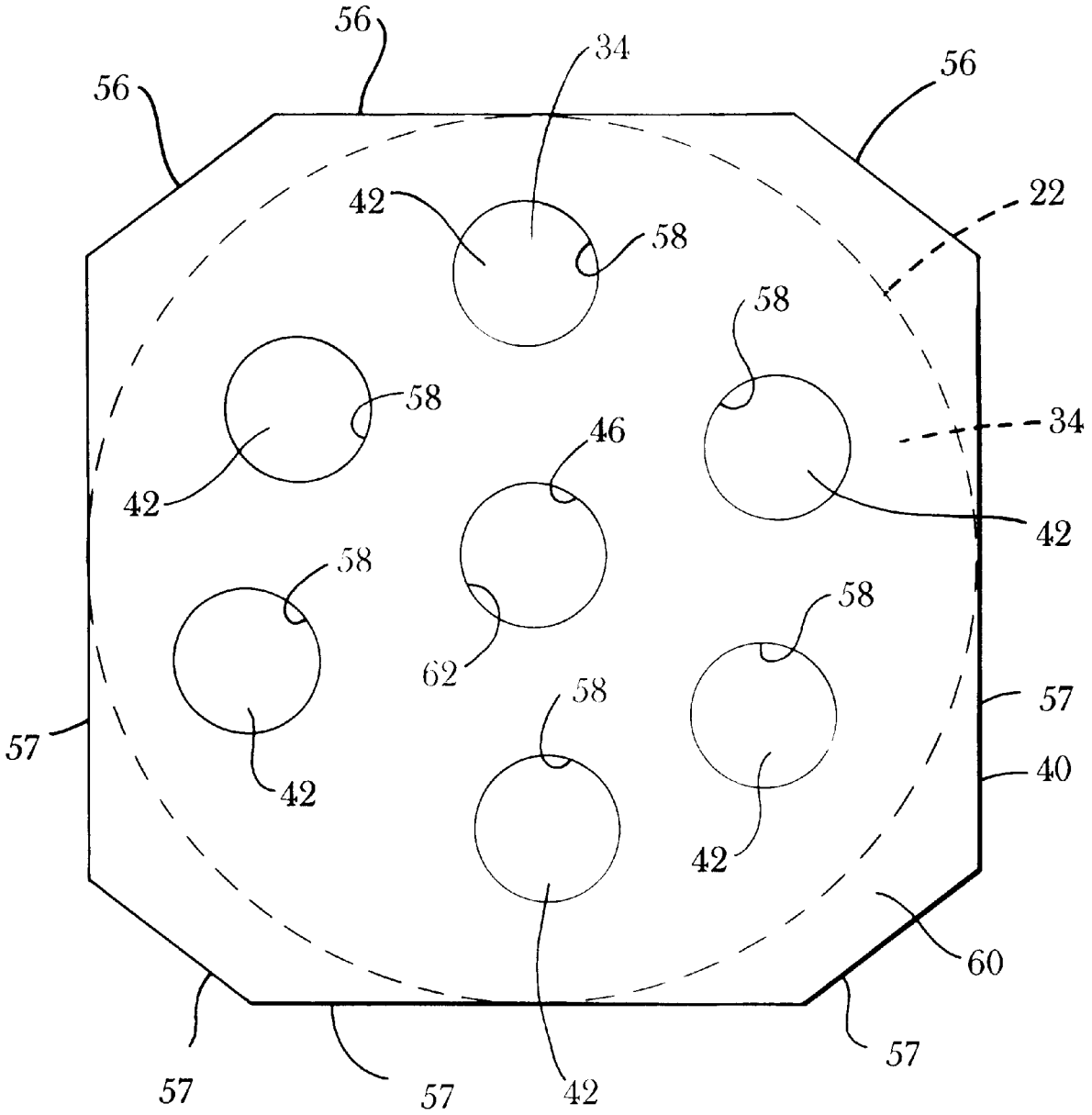
FIG. 6 is a front elevation view showing a diffraction grating disc having a mask element removably connected to or positioned on the disc.

Another invention embodiment, illustrated in FIG. 6, includes a mask element 40 removably connected to or positioned over diffraction grating 22 for covering and exposing predetermined portions 42 of diffractive surface 34 to create a predetermined design, designs and/or information.

In operation and use, barrel portion 44 of socket 14 is extended through opening 46 of disc 22, and disc 22 is positioned against flange 48 of socket 14. Threaded retaining ring 16 is then threadably positioned over threaded barrel portion 44 to hold disc 22 between flange 48 and retaining ring 16.

Base 50 of light bulb 18 is then inserted through retaining ring 16 and through disc opening 46 into bore 52 of lamp socket 14 where a conventional securing means (threads, pins, bayonet mount, etc.) (not shown) connects bulb base 50 to socket 14.

Socket 14 is attached to support 12, in the embodiment illustrated, by means of bolt 26 passing through support openings 28, 28' and through socket opening 30. Nut and washer combination 32 are attached to bolt 26 for holding the bolt in position.

In a preferred embodiment, reflective surface 24 is plated, painted or otherwise attached to the distal end of globe 54 of light bulb 18 so that light rays from the bulb are directed back towards diffractive/reflective surface 34 and so that a direct view of the bare bulb by a forwardly positioned observer is shielded.

Various configurations of mask element 40 can be provided for creating different designs and/or information when light from bulb 18 is reflected from diffractive surface 34. For example, mask element 40, shown in FIG. 6, is in the form of an envelope having an open end or sides 56 and closed sides 57. Cut-out portions 58 within a side 60 of mask element 40 are in predetermined shapes or provide predetermined information. Prior to assembly of lamp 10, disc 22 is positioned within mask envelope 40 with cut-out portions 58 exposing portions 42 of reflective surface 34 of disc 22. Mask element 40 includes a central opening 62 which is aligned with disc central opening 46 to permit proper assembly of lamp 10.

Mask element 40 may be of any appropriate shape. An octagon shape is illustrated in FIG. 6. Mask element 40 is preferably comprised of paper, cardboard, plastic or other similar material. An alternative configuration for mask element 40 would be use of sheet metal or plastic as a sheet of material for the mask element. Connecting tabs or elements (not shown) could be spaced around the circumference of the sheet metal or plastic sheet mask (not shown) to connect the mask to disc 22. The tabs could be bent around and over the edge of disc 22 to affix the sheet metal or plastic sheet mask to the disc.

It should be understood that various types of supports can be used in accordance with this invention, other than the specific support 12 described and illustrated. For example, various means of attachment or means of suspension can be used to allow lamp assembly 10 to be set upon, attached to or hung from a surface. Examples of different configurations for the lamp assembly of this invention are a table lamp, night light, wall light, pendant light, etc.

It should also be understood that various types and configurations of connecting elements can be used in accordance with this invention, other than the specific connecting elements 14, 16, 26, 32, 44 and 48 described and illustrated, for connecting a light socket to the lamp support and for connecting the diffraction grating to the light socket.

A plurality of lamp assemblies in accordance with this invention can be used for various purposes. For example, more than one lamp assembly of this invention can be used in cooperation with a make-up mirror, a chandelier, a suspended string of lamps which can be used as a party light string or Christmas tree light string, or a geometric arrangement of lamps can be positioned to form different designs, such as a triangle, star or arrow.

The lamp of this invention can also be used as a mobile lighting fixture for use in a vehicle, such as an automobile, bicycle, boat, etc. Examples of this type of use of the lamp are as a safety beacon on a bicycle, as an accessory brake light, turn signal or parking light. Another configuration of the invention would be a battery operated embodiment designed to be used by a human or animal as a safety beacon.

The lamp of this invention can also be used as a mechanized or animated lamp, a lighting fixture or array of lamps. The invention may also be used as an emergency flasher, directional flasher, point of purchase display, a "disco ball", etc. Disc 22 can also be formed in various predetermined shapes, such as a star, cross, heart, butterfly, angel, etc.

Various sizes of discs or diffraction gratings 22 can be used, and diffraction grating 22 can be milled, cast or otherwise formed into a three dimensional shape (not shown). Light bulbs of various shapes, sizes and finishes can also be used. Flashing and flickering type bulbs are examples of light bulbs that may be embodied in the lamp assembly of this invention.

The invention in its broader aspects is not limited to the specific details shown and described, and departures may be made from such details without departing from the principles of the invention and without sacrificing its chief advantages.

What is claimed is:

1. A lamp assembly, comprising:

a support;

a light bulb socket connected to said support for removably receiving a light bulb within said socket;

an electrical conductor connected in electrical circuit relationship with said socket for conducting electricity to a light bulb within said socket from a source of electrical power; and a diffraction grating connected in operative relationship with said socket and with respect to a light bulb within said socket for reflecting light from said light bulb to produce a spectral visual effect.

2. A lamp assembly as in claim 1 further including a light bulb fastened within said socket and wherein said light bulb includes a reflective surface for directing light from said light bulb toward said diffraction grating when said light bulb is positioned within said socket.

3. A lamp assembly as in claim 2 wherein said light bulb, said socket and said diffraction grating are positioned in substantially coaxial relationship with each other.

4. A lamp assembly as in claim 3 wherein said socket is adjustably connected to said support.

5. A lamp assembly as in claim 3 wherein said diffraction grating is in the form of a flat disc.

6. A lamp assembly as in claim 5 wherein said diffraction grating is a CD.

7. A lamp assembly as in claim 5 wherein said diffraction grating is a CD-ROM.

8. A lamp assembly as in claim 5 wherein said diffraction grating is a laserdisc.

9. A lamp assembly as in claim 1 wherein said diffraction grating includes a first diffractive surface and a second opposed surface, and wherein said first diffractive surface is positioned with respect to said light bulb for reflecting light from said bulb.

10. A lamp assembly as in claim 9 further including printed matter on said first diffractive surface for creating a predetermined design, designs and/or information.

11. A lamp assembly as in claim 9 further including a mask element removably connected to said diffraction grating for covering and exposing predetermined portions of said first diffractive surface to create a predetermined design, designs and/or information.

12. A lamp assembly as in claim 11 wherein said mask element includes an envelope having open sides and closed sides.

13. A lamp assembly as in claim 11 wherein said mask element includes cut-out portions therein for positioning over said first surface.

14. A lamp assembly as in claim 11 wherein said mask element includes a central opening therein for predetermined alignment with said diffracting grating.

15. A lamp assembly as in claim 5 wherein said diffraction grating is a mini disc.

16. A lamp assembly as in claim 5 wherein said diffraction grating is a DVD.

* * * * *